US006955320B2

(12) United States Patent
Martinez

(10) Patent No.: US 6,955,320 B2
(45) Date of Patent: Oct. 18, 2005

(54) UNWINDING SYSTEM FOR HANDLING REELS OF TISSUE

(76) Inventor: Manuel Torres Martinez, c/Sancho el Fuerte, 21, 31007 Pamplona (ES)

( * ) Notice: Subject to any disclaimer, the term of this patent is extended or adjusted under 35 U.S.C. 154(b) by 12 days.

(21) Appl. No.: 10/627,401

(22) Filed: Jul. 24, 2003

(65) Prior Publication Data

US 2004/0206848 A1 Oct. 21, 2004

(30) Foreign Application Priority Data

Jul. 25, 2002 (ES) ..... 200201747

(51) Int. Cl.[7] ..... B65H 19/28

(52) U.S. Cl. ..... 242/555.1; 242/555.2; 242/555.3; 242/559.4; 242/596.5

(58) Field of Search ..... 242/555.1, 555.2, 242/555.3, 556.1, 559.4, 613.5, 596.5, 596.6; 294/82.13

(56) References Cited

U.S. PATENT DOCUMENTS 2,086,144 A * 7/1937 Wood ..... 242/555.3
3,970,039 A 7/1976 Kawano
4,179,330 A 12/1979 Page
4,278,489 A * 7/1981 Horsley ..... 156/361
4,378,095 A * 3/1983 Reynolds ..... 242/578.1
4,564,413 A * 1/1986 Murakami ..... 156/504
5,697,575 A * 12/1997 Moore et al. ..... 242/555.3
5,906,333 A 5/1999 Fortuna et al.
5,975,457 A * 11/1999 Forbes ..... 242/552
6,030,496 A 2/2000 Baggot et al.
6,355,139 B1 3/2002 Baggot et al.
6,440,268 B1 8/2002 Baggot et al.
6,786,264 B1 * 9/2004 Torres Martinez ..... 156/504

* cited by examiner

*Primary Examiner*—Sang Kim
(74) *Attorney, Agent, or Firm*—Townsend and Townsend and Crew LLP

(57) ABSTRACT

An unwinding system for handling reels of tissue, which for each laminar ply of tissue to be applied consists of two reel-carrier units onto which are mounted the respective reels, one of which supplies the laminar band for processing, whilst the other remains on stand-by to be spliced onto the processing line when the supply reel runs out, with the reel-carriers capable of vertical displacement, for the separate positioning of the respective reels, one in the upper part and the other in the lower part, for the preparation of the stand-by reel whilst the other is in the operating stage; with the reels mounted in the reel-carriers by means of attachment cones, by means of which unwinding rotation is controlled.

7 Claims, 17 Drawing Sheets

UNWINDING SYSTEM FOR HANDLING REELS OF TISSUE

This application claims priority under 35 U.S.C. §119(a) to Spanish Patent Application ES 200201747, the entire disclosure of which is incorporated herein by reference for all purposes.

BACKGROUND OF THE INVENTION

The invention refers to an unwinding system, which serves the purpose of improving the conditions for the handling of large reels of tissue in processes involving the application of this kind of material, for example in the formation of small rolls. Tissue is a laminar material of extremely fine paper, used to manufacture, for example, rolls of toilet paper, rolls of kitchen paper and such like.

The rolls of tissue paper may consist of one or two plies. During the manufacturing stage the initial web is completely smooth, to which and in certain cases a specific corrugated effect is applied, which is how it is finally marketed.

The nature of this material means that, during its processing in the formation of the rolls, the web should not be subject to major stresses, as this will lead to the loss of the corrugated effect. Furthermore, the rolls for toilet paper and the like are sold in different sizes and diameters; which means that by subjecting the corresponding web, during the formation of the rolls, to greater or lesser tension a variable compaction of the rolls will be achieved, even allowing for different lengths of the roll-forming web to be applied to rolls of the same diameter.

In order to suitably control the compaction of the rolls, so that they include a pre-established length of web, the roll-forming web must be fed under controlled conditions of tension. This must be combined with an infeed speed that renders the production profitable.

The process for forming the aforementioned rolls is based on the infeed of the web from a large reel which exceeds two metres in diameter, from which the laminar web of tissue is unwound in order to form the commercial rolls, with one or two plies of laminar material, in such a way that when the infeed reel runs out it can be replaced by another for continuing the process.

According to a traditional solution, the infeed reel for the laminar roll-forming web is mounted on a system of belts, much like a bed. These belts are drive belts, whereby their movement rotates the reel mounted on them, thus unwinding the reel. When the end of the reel is reached the drive is halted, bringing the process to a stop for the replacement of the reel and the splicing of the new reel onto the web supplying the process.

The splicing of the new reels for continuing supplying the process may be by tying, gluing or any other traditional solution. This operation is always performed manually, as the tests and trials for automation that have been effected to date have not provided satisfactory results given the nature of the laminar tissue material, which has a very low tensile strength, so that it breaks easily when subjected to high stresses. This material is also very flexible, which makes automatic cutting difficult.

Splicing the new reels manually when the infeed reel runs out, with the consequent halt in the production process, means the inconvenience of a low-performance process due to the stoppages for replacing the reels, with the consequent decelerations and accelerations of the supply of the laminar web in said stoppages, in addition to the time required for the actual splicing operation itself.

The drive system for unwinding using motorised belts entails furthermore a series of drawbacks stemming from the very nature of this system, as for example:

- The rubbing of the belts against the reel to be driven generates a large amount of dust, with a high risk of fire.
- The wear on the belts and their moving assembly parts means that considerable maintenance is required.
- The control of the unwinding is largely inaccurate, which is reflected in the results.
- The wear on the belts through the rubbing against the reels means that they need to be replaced frequently, at significant financial expense.
- The direct contact between the infeed reel and the belts driving the unwinding represents an unfavourable hygienic circumstance with regard to the laminar web, especially when taking into account the applications for which it is destined.
- The whole installation occupies a large area, as in addition to the support belts for the reels feeding the laminar webs, lateral rails are required for loading and unloading the reels with regard to the support belts; in a manner that, for example, an installation for the processing of two-ply material requires two pairs of reel-carriers, so that in each pair one reel can be in the operation mode, whilst the other reel is made ready to remain on stand-by to be spliced when the first reel runs out, with the entire installation taking up a rectangular area of, at least, 14 metres in length and 3.5 metres in width.

In view of these drawbacks of the unwinding system in the processing of the aforesaid laminar webs of tissue, whereby the infeed reels rotate on a bed of motorised belts, attempts have been made to perform the unwinding by means of control cones that act on the mandrel of the reels, as is done in the sector of corrugated cardboard. However, all the tests carried out so far with regard to this have been unsuccessful due to the specific properties of the tissue material, namely its low tensile strength and its great flexibility which makes the cutting process difficult.

Besides the lack of success in the attempts to control the unwinding by means of cones acting on the mandrel of the reels, no progress has been made in replacing manual splicing, as the attempts at automation in this respect have also been unsuccessful, given their great complexity and high costs.

SUMMARY OF THE INVENTION

In accordance with the invention, a system is proposed whereby the unwinding is controlled by cones from the mandrel of the reels supplying the laminar webs of tissue, furthermore employing an automatic splicing system for joining the webs on the fresh reels to the infeed web of a previous reel that is running out, thus permitting uninterrupted continuation of the process.

Accordingly, for each ply of laminar web of tissue to be applied to the rolls to be formed by this system, two reels are arranged with one mounted above the other, with a control of the unwinding by means of cones on the mandrels of said reels, in a vertical displacement arrangement so that they are positioned separately, one on the lower part and one on the higher part, whereby whilst from one the feed is provided for application in the process, the other may be prepared to continue supplying material when the first reel is spent.

The web of the reel in stand-by is joined to the web supplying the application process by means of automatic splicing. This involves a drive mechanism that undertakes said operation in a manner whereby once the splice has been effected, the web from the reel that is running out is cut by means of an automatic mechanism.

The reels are mounted by means of bushings that fit into the ends of the mandrels of the same, with these bushings providing for the placing of attachment means for the lifting of the reels and their mounting in the assembly position, with said bushings also serving as housing for the cones for holding the reels in the assembly. These cones for their part are axially displaceable forward and backwards for holding the reels in the functional assembly and releasing the same when they must be removed.

It is envisaged that the reels will be placed in their position of assembly by means of ancillary lifting and transport means, whilst reel removal for the withdrawal of the mandrel or final remainder of the same will be performed by freefall by means of the withdrawal of the holding cones, with the provision below of means for their collection and removal.

The automatic cutting mechanism consists of a cutting device in the shape of a comb, which operates in conjunction with a reversal of the rotation of the reel feeding the web to be cut, in a manner whereby in the cutting action the cutting device rests against the web with the tips on its edge and furthermore there is a tightening in the tension of the web, which leads to the perfect cut of the web, in spite of the flexibility of the same.

In accordance with all the above, and by means of the system covered by the invention, a number of outstanding benefits are achieved, such as:

There is a marked reduction in the amount of dust generated and, consequently, in the risk of fire.

There is a considerable reduction in maintenance requirements, as there are no belts in contact with the reels.

Full control is exerted over the unwinding, thanks to the mounting of the reels by means of cones and the control of the unwinding by means of said cones.

There is a noticeable reduction in the space occupied by the installation.

The mounting of the reels leaves an open space below the position of the same, which enables the incorporation in this area of suction means to collect the dust that is produced by the tissue material, with great advantage over the traditional system of supporting the reels on a bed of belts, in which the belts that support the reels do not permit the incorporation of means for collecting the dust and this is deposited on the belts.

By means of the automatic splicing there is a considerable reduction in the time required for splicing during the change of reels, with no need to stop the application process. For example, with the traditional manual splicing system, each change of reel requires a stoppage of around six minutes, whereas with the system of the invention the feed is not interrupted, with the splicing taking place automatically; tests have been performed, employing this new system, in which the splicing has been effected at an infeed speed for the web of tissue of 100 metres per minute, with a magazine of 6 metres, with no need to interrupt the process. The infeed speed during the splicing may obviously be increased by increasing the length of the back-up magazine of the web.

By means of the control of the unwinding using the cones holding the reels, control is exerted furthermore on the tension of the web of tissue, allowing for the obtention in each case of the degree of compaction that is required in the rolls that are formed.

All this means that the system of the invention has characteristics that give it its own identity and a preferential nature with regard to traditional systems for the same function.

DETAILED DESCRIPTION OF THE INVENTION

Figure 1:
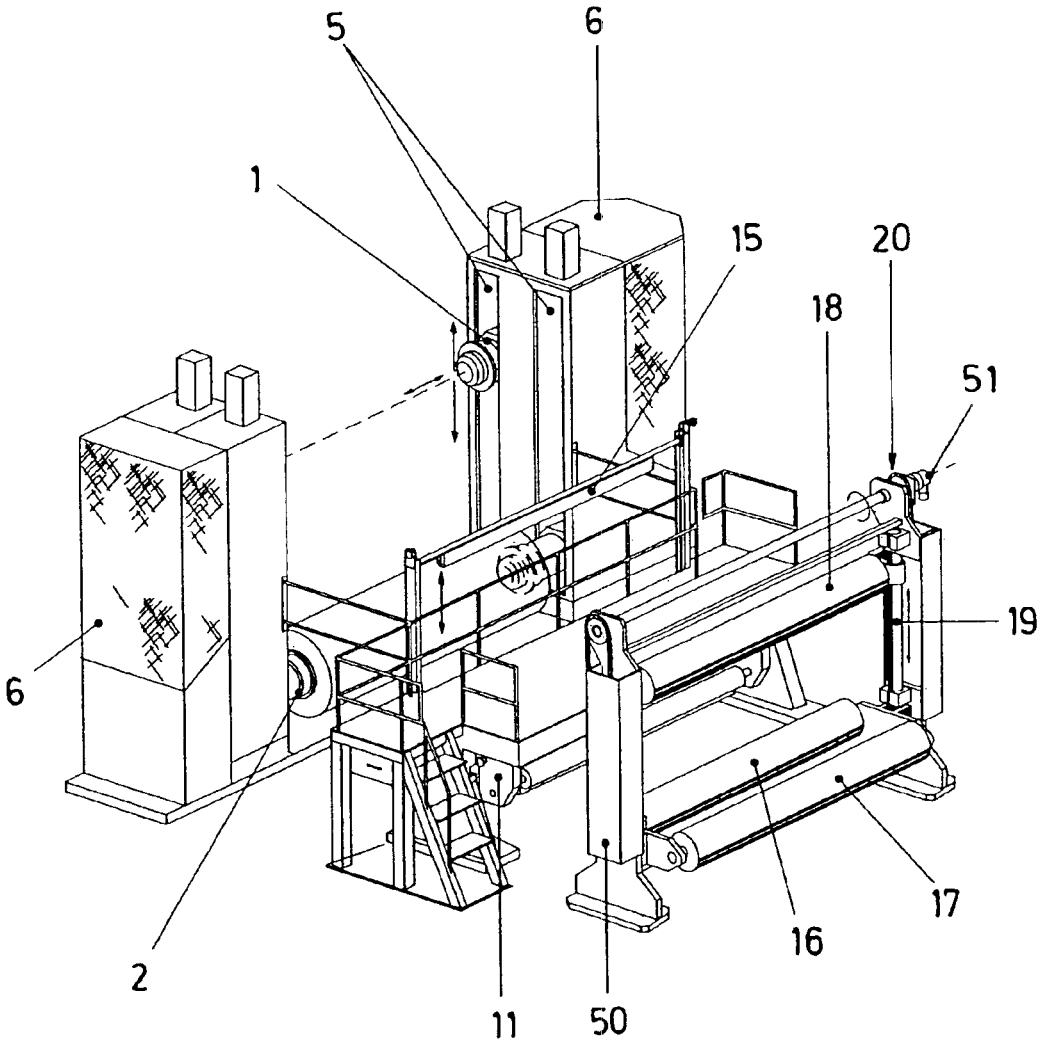
FIG. 1 shows a perspective view of a practical embodiment of the system propounded, for a process of unwinding involving a single ply.
Figure 2:
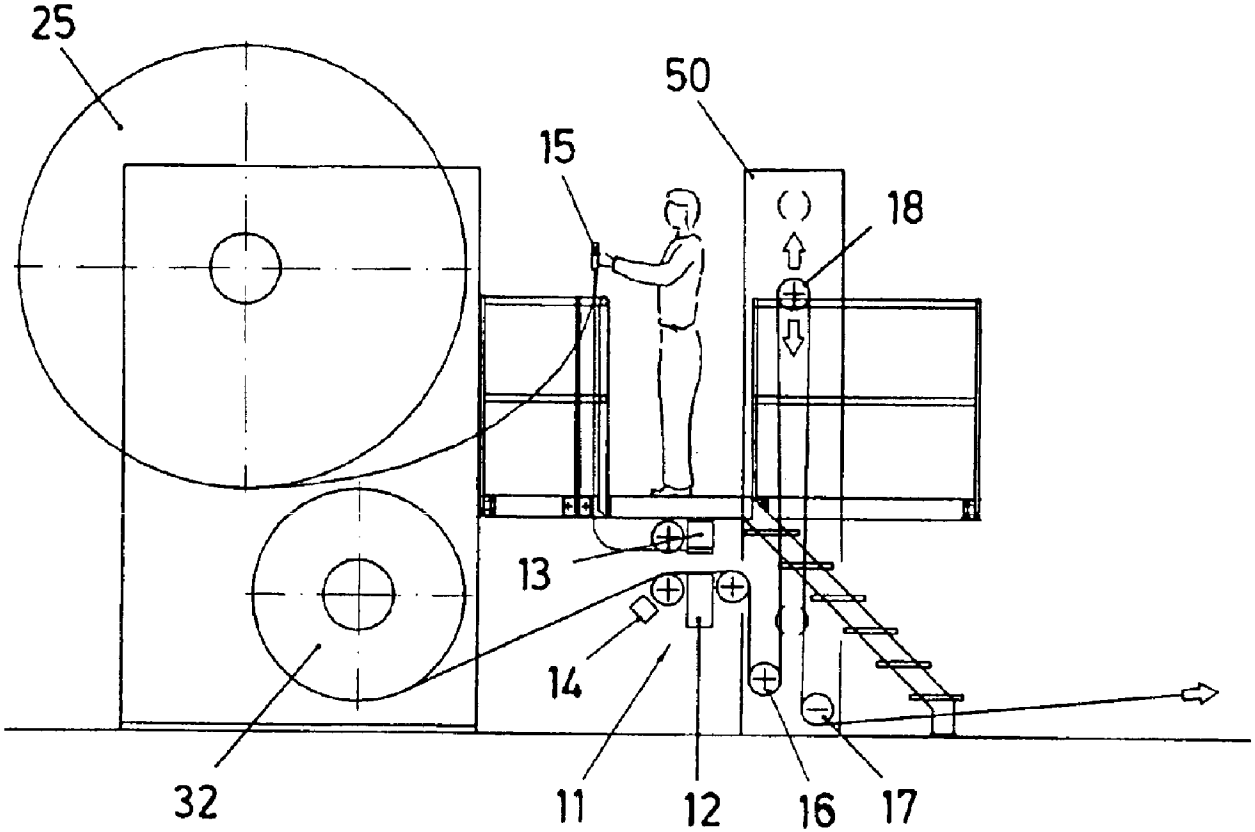
FIG. 2 is a side view of the system according to the embodiment in the previous figure.
Figure 3:
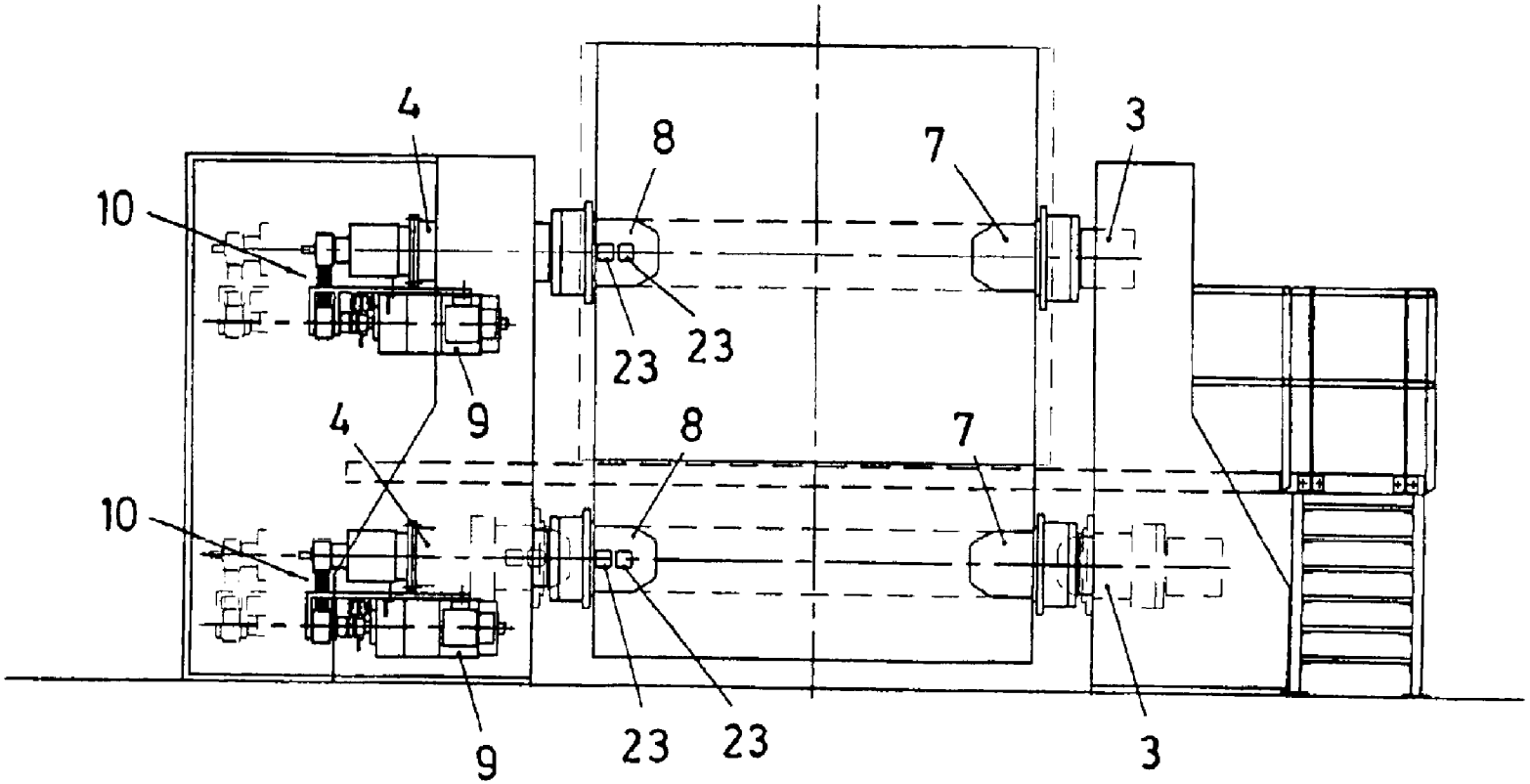
FIG. 3 is a front elevation view with regard to the previous figure.
Figure 4:
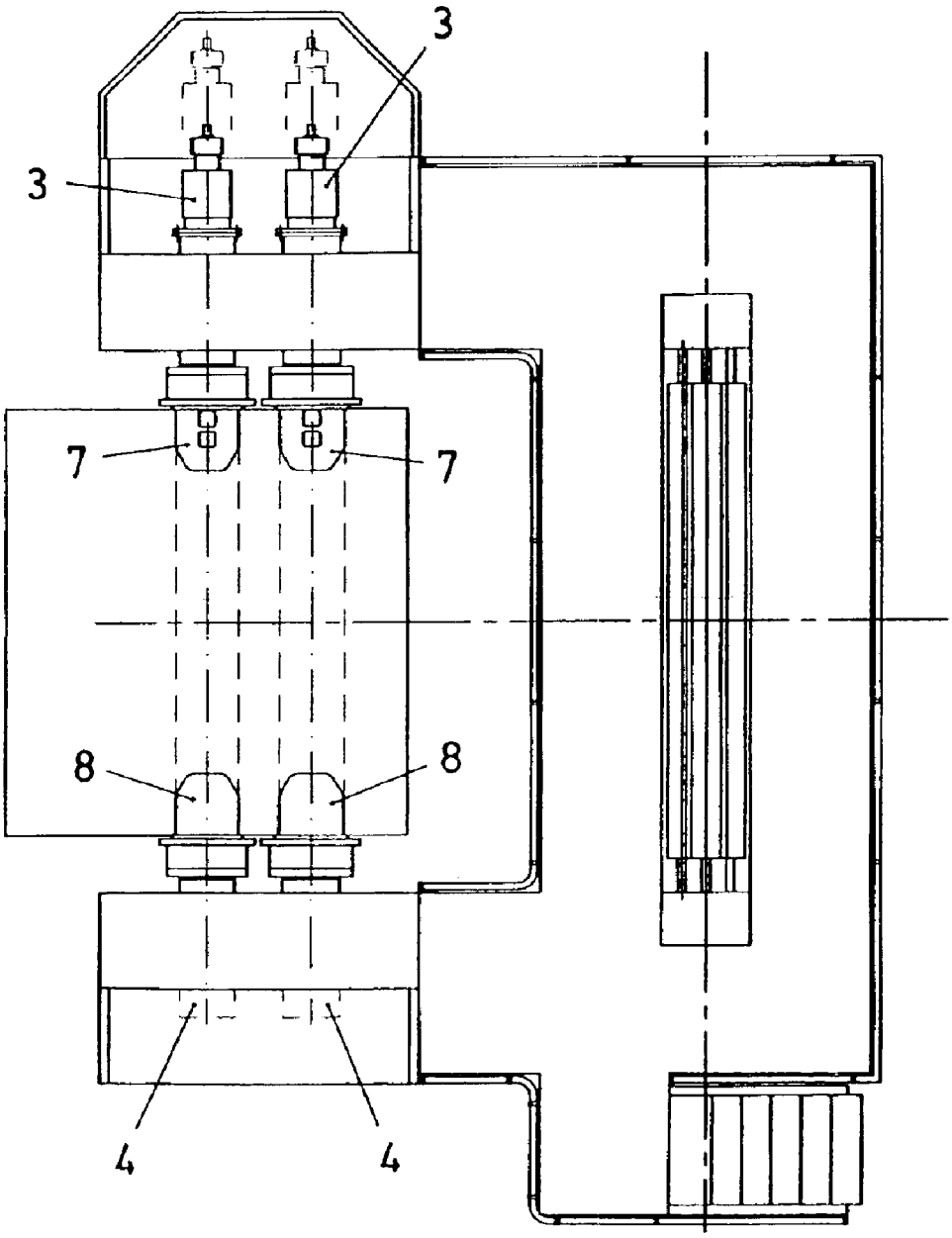
FIG. 4 is a plan view with regard to FIG. 2.
Figure 5:
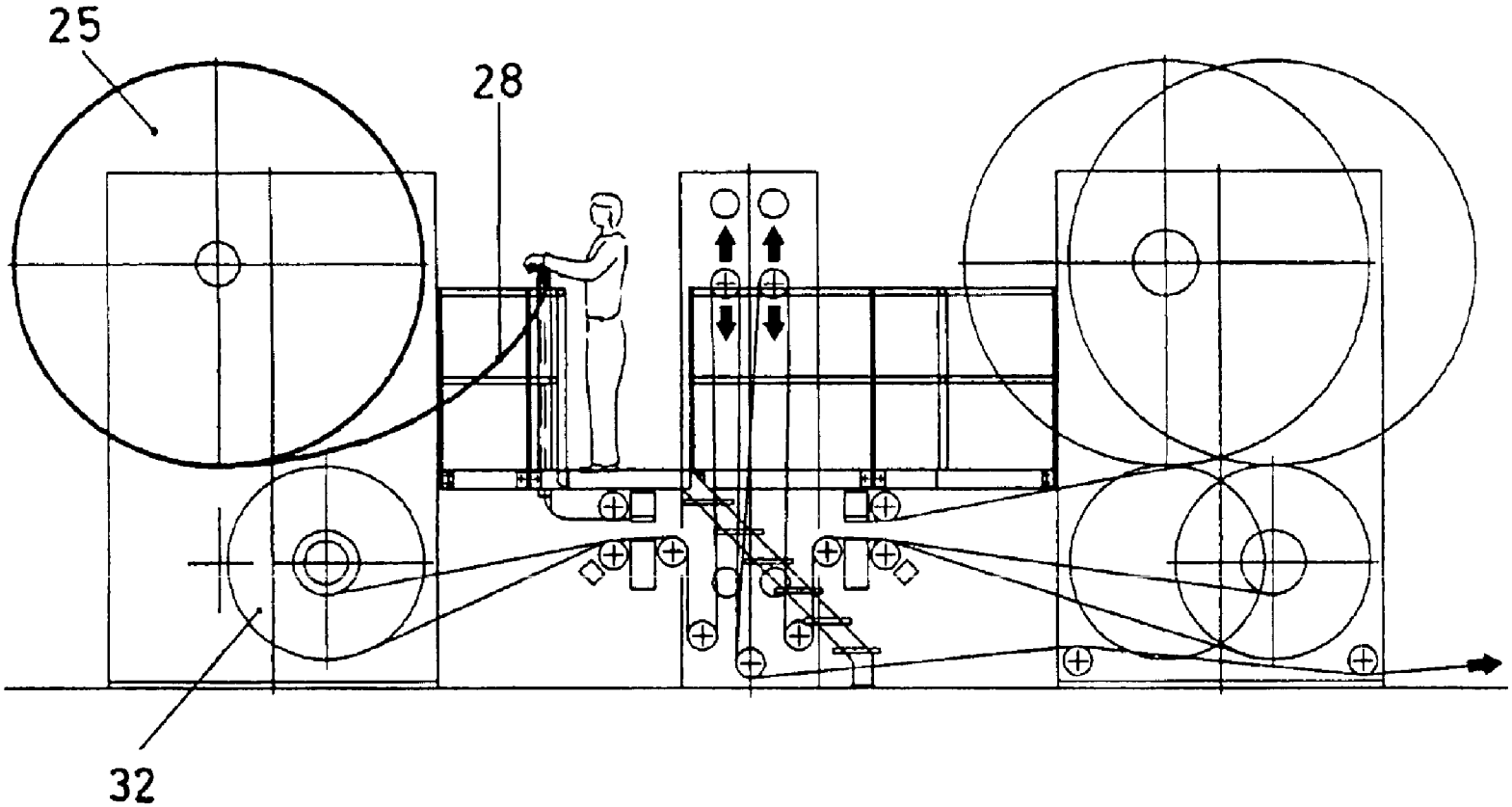
FIG. 5 is a side view of a embodiment of the system for an unwinding process involving two plies.

The purpose of the invention is an unwinding system for handling reels of laminar webs of tissue for the formation of commercial rolls of the aforesaid webs or similar applications.

The system may be applied in processes for the application of the webs to form one-ply material, as in the embodiment of FIGS. 1 to 4, or for the application the webs to form two-ply material, as in the embodiment of FIGS. 5, 6, 7 and 20, including for this, respectively, one or two unwinding units in the installation.

Each unwinding unit consists of two reel-carriers (1 and 2), which comprise respective cone-carrier assemblies (3 and 4) which are mounted on corresponding vertical guides (5), with each pair of the aforementioned cone-carriers (3 and 4) liable to displacement along their respective guides (5), by means of a drive mechanism included within the actual guides (5), in a manner whereby each one of the reel-carriers (1 and 2) may be displaced in height along the respective mounting structures (6).

Each cone-carrier assembly (3 and 4) incorporates a drive mechanism that enables it to be displaced along its longitudinal axis, with those cone-carriers (3 and 4) fitted with pneumatically expandable cones (7 and 8); the cone-carriers (4) on one side are associated with their respective motors (9), by means of corresponding drives (10), being operated in a rotary movement. The motors (9) are controlled by an electronic system, by means of which control is effected of the direction of rotation, the speed and the torque of each one of these motors (9).

The unwinding unit furthermore comprises a splicing device that consists of a head (11), comprising a fixed bar (12), a moving bar (13) which is operated by means of a system of pneumatic cylinders, a cutting device (14), which includes a blade operated by pneumatic actuators, and another moving bar (15), which is operated by a chain and pinion system.

The splicing device is completed with a mechanism formed by two fixed rollers (16 and 17), a moving roller (18) that may be displaced vertically along guides (19) and a mechanism (20) for synchronising the displacement of said moving roller (18).

The system contemplates various bushings (21), which are fitted by insertion into the ends of the mandrel of the reels to move the latter to their mounting position in the installation and hold them in said mounting position.

Figure 8:
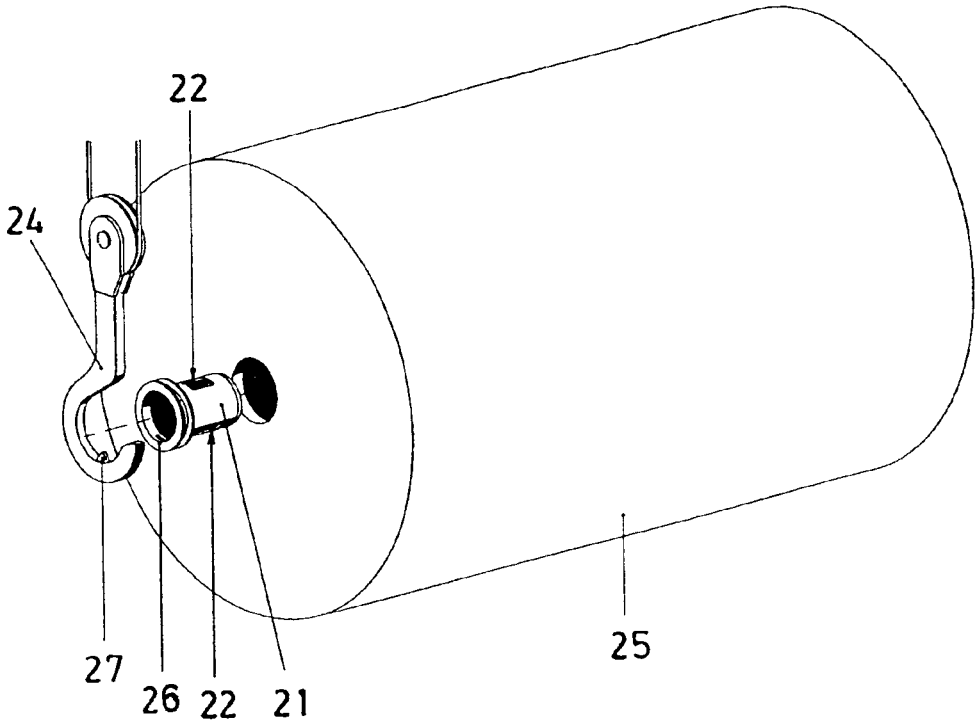
FIG. 8 is a perspective view of a reel, with the attachment bushing at one end of the same and the corresponding lifting hook positioned in front of the end of said reel.
Figure 9:
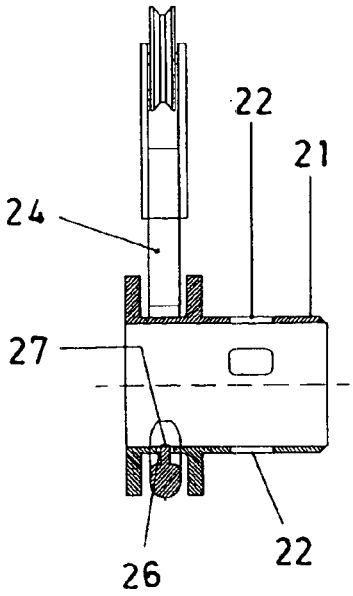
FIG. 9 is a side cross-section view of a bushing for insertion into the ends of the reels, mounted on the corresponding lifting hook for the positioning of the reels.

According to FIGS. 8 and 9, said bushings (21) are fitted with lateral windows (22) that are strategically positioned, designed for the insertion of various keys (23) (see FIG. 3) on the cones (7 and 8) of the reel-carriers (1 and 2).

Figure 6:
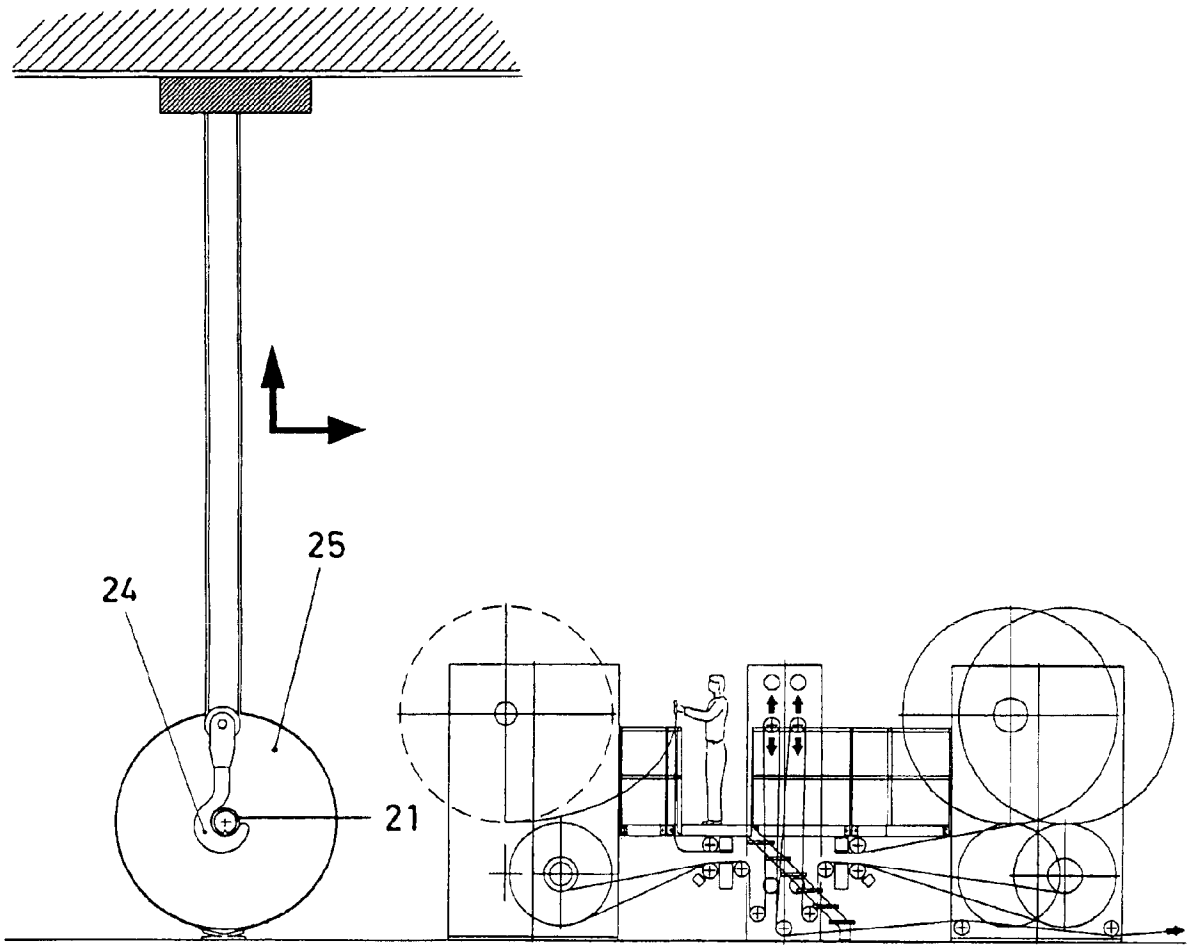
FIGS. 6 and 7 show, in two successive positions, the sequence of setting a reel in place on the system.
Figure 7:
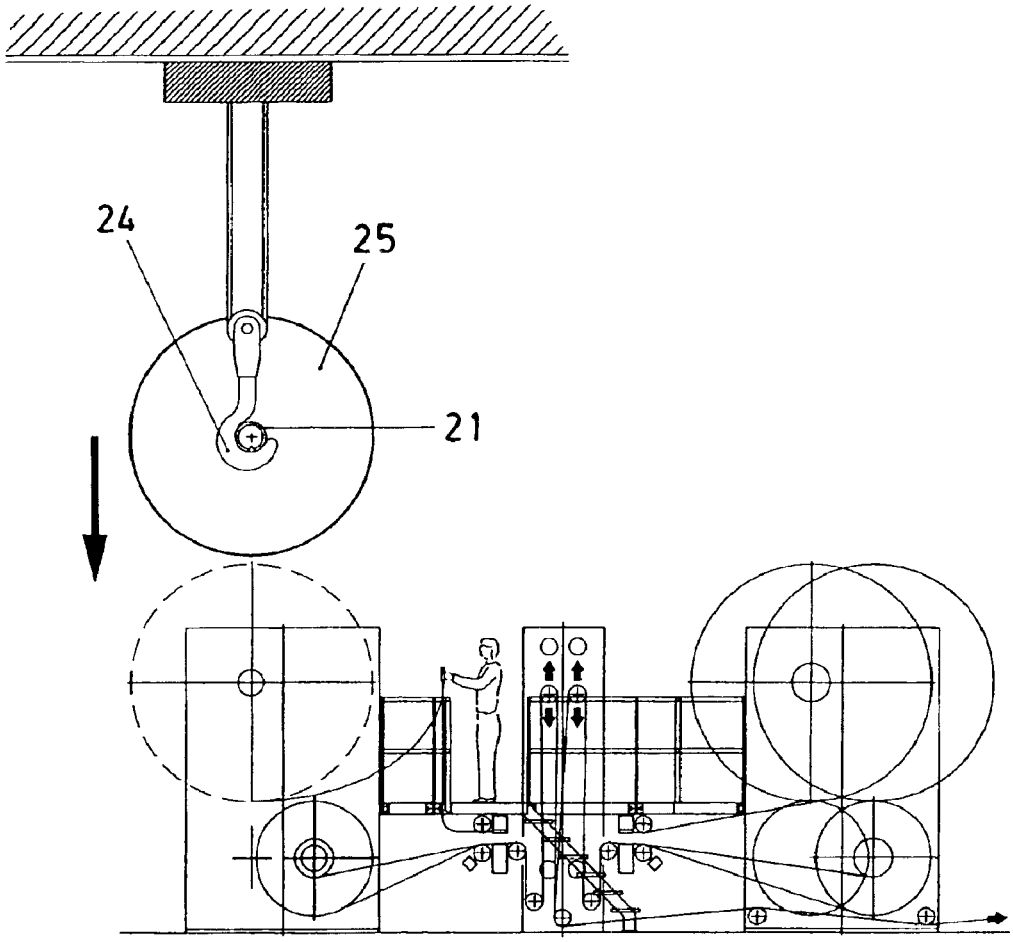

In accordance with a embodiment, as shown in FIGS. 6 and 7, the assembly of the reels in the unwinding installation may be undertaken by transporting them to the installation area; there, by means of hooks (24) on a lifting device, the reel (25) is gripped, to be lifted and taken to the corresponding mounting position. This solution is not restrictive, with any other open to use for enabling the reels (25) to be taken to the mounting position on the installation.

For this operation involving the mounting of the reels (25), respective bushings (21) are inserted into the ends of their mandrel; these bushings have, on a part that remains outside, a groove in which a notch (26) has been defined and strategically located with regard to the windows (22) on said bushings (21).

For the raising of the reel (25) to the mounting position, the hooks (24) of the lifting device fit into the groove on the bushings (21), ensuring that the notch (26) coincides with a tooth (27) on the hooks (24), whereby said bushings (21) are suitably positioned in order that in the attachment assembly of the reel-carriers (1 and 2) the windows (22) on the aforementioned bushings (21) coincide with the keys (23) on the attachment cones (7 and 8).

The bushings (21) may be attached to the reel (25) to be lifted beforehand; then, they may be attached to the hooks (24) for lifting, turning the bushings (21) manually in their position on the reels (25) in order to bring the notch (26) in the groove of the same in line with the tooth (27) on the hooks (24). Nevertheless, without amending the concept, a process may also be contemplated whereby the bushings (21) are mounted in a stable manner on the hooks (24) and through the reciprocity of forms the position of said bushings (21) is fixed and determined, in a manner whereby the assembly of the hooks (24) with the bushings (21) already attached to them is presented to the reel (25), for the bushings (21) to be inserted into its mandrel in this arrangement.

Between the outer part of the bushings (21) and the corresponding reel (25), the incorporation is envisaged of a Teflon washer, in order to avoid the deterioration of the laminar material on the reel (25) in the area surrounding the mandrel.

When the reel (25) to be incorporated in the assembly is raised, by means of the hooks (24) or whichever hoisting system is employed, either in an automatic manner or by manually pressing a button, the corresponding reel-carrier assemblies (3 and 4) are displaced in order to provide the maximum distance between them and at the same time the respective cones (7 and 8) rotate synchronously until their corresponding keys (23) are in the position required.

The reel (25) is then inserted until the bushings (21) fitted in the mandrel on the same are positioned facing the cones (7 and 8) in the mounting position and, subsequently, by means of a button operated accordingly, the cone-carrier assemblies (3 and 4) are displaced until they insert the cones (7 and 8) in the bushings (21), with verification of the coupling effected by means of a sensor installed for the purpose.

nce this has been achieved, the keys (23) on the cones (7 and 8) expand pneumatically, fitting into the windows (22) on the bushings (21), which is verified by means of respective sensors, with the bushings (21) thus being mechanically attached and, therefore, the reel (25) with the cones (7 and 8).

When the reel (25) is ready in its mount, as described above, it is rotated until the leading edge (28) of the laminar web of the same is in a suitable position to enable an operator in a control position to handle said leading edge (28) to prepare the splicing in the unwinding unit.

For this preparation (FIGS. 11 to 14), the bar (15) incorporates a moving clamp (29), which features a lip (30) that is arranged to fit into a notch (31) on the bar (15) when said clamp (29) closes on it.

Figure 10:
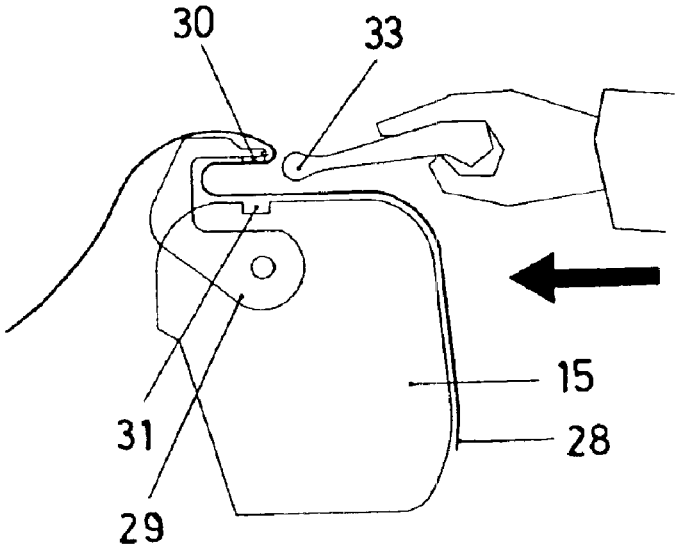
FIGS. 10 to 14 show successive positions of the sequence for the preparation of a laminar web that is to remain on stand-by, on the corresponding automatic splicing mechanism.

In the preparation of the splicing, the bar (15) is displaced to the upper position of its run over the preparation area and when it is in position a mechanism acts upon the clamp (29), in a manner whereby it is detached from the bar (15). The operator then takes the leading edge (28) of the laminar web and places it on the bar (15), making sure to align the new reel (25) with the one currently in operation (32), inserting the leading edge (28) of the web being prepared, either by hand or by means of a tool (33), between the clamp (29) and the bar (15), as shown in FIG. 10.

Figure 11:
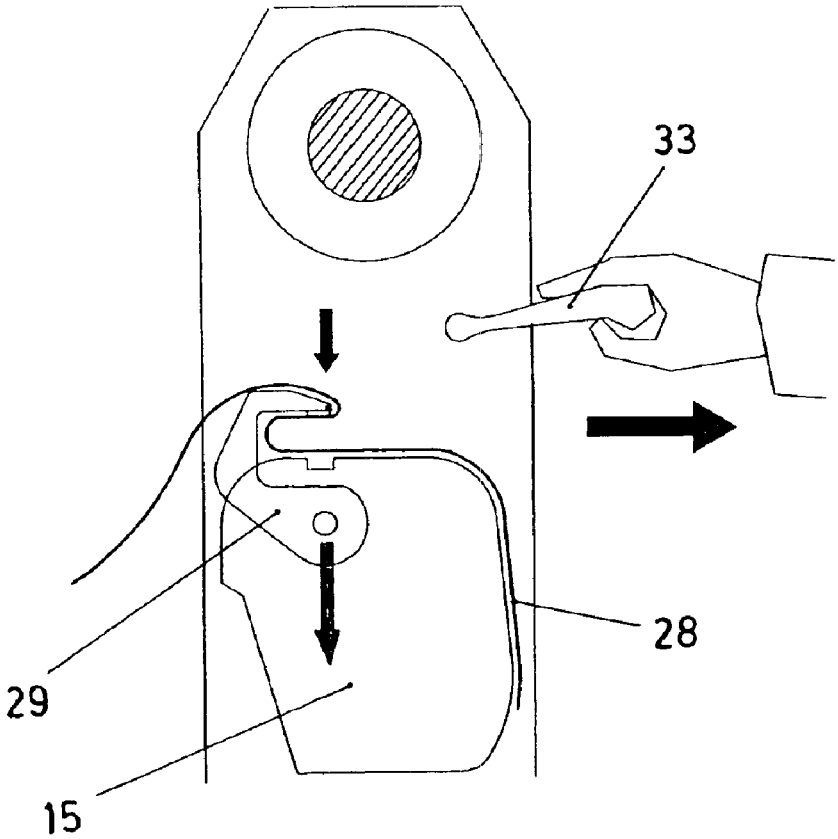

Once the leading edge (28) of the web being prepared has been arranged in this manner, the bar (15) is lowered and by means of the relevant mechanism the clamp (29) is closed onto said bar (15), as shown in FIG. 11, whereby the leading edge (28) of the web is securely held between the lip (30) and the notch (31).

Figure 12:
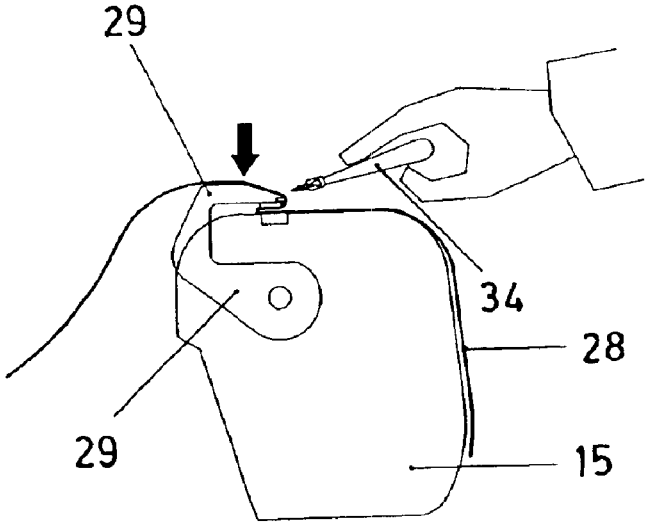
Figure 13:
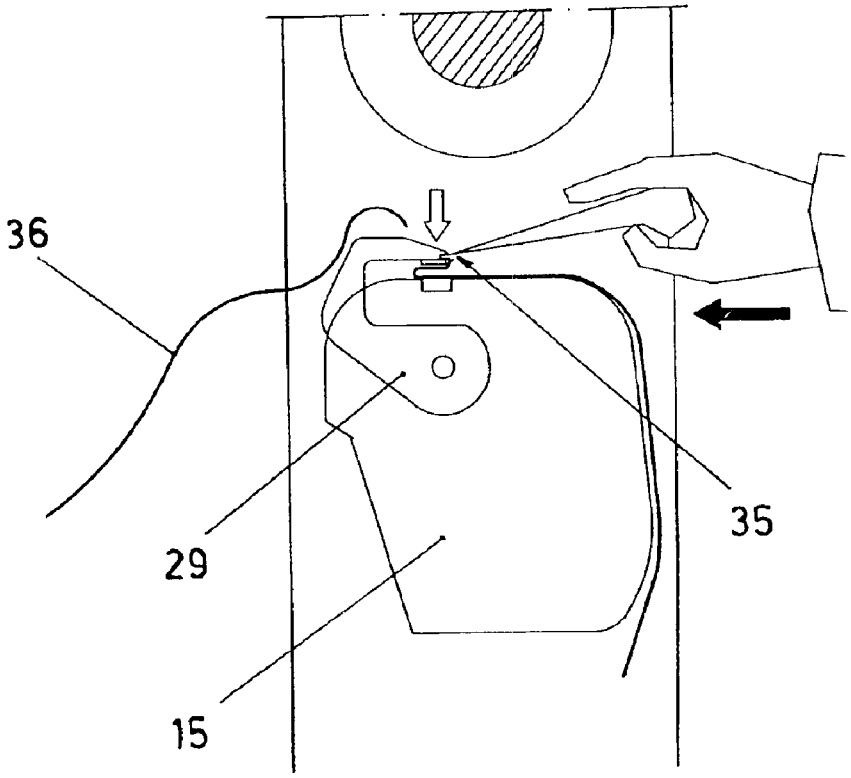

In the next stage, as shown in FIG. 12, the operator cuts the remaining paper of the laminar web by sliding a tool (34) along a groove (35) on the clamp (29), and finally he removes any excess paper (36), as shown in FIG. 13.

Figure 14:
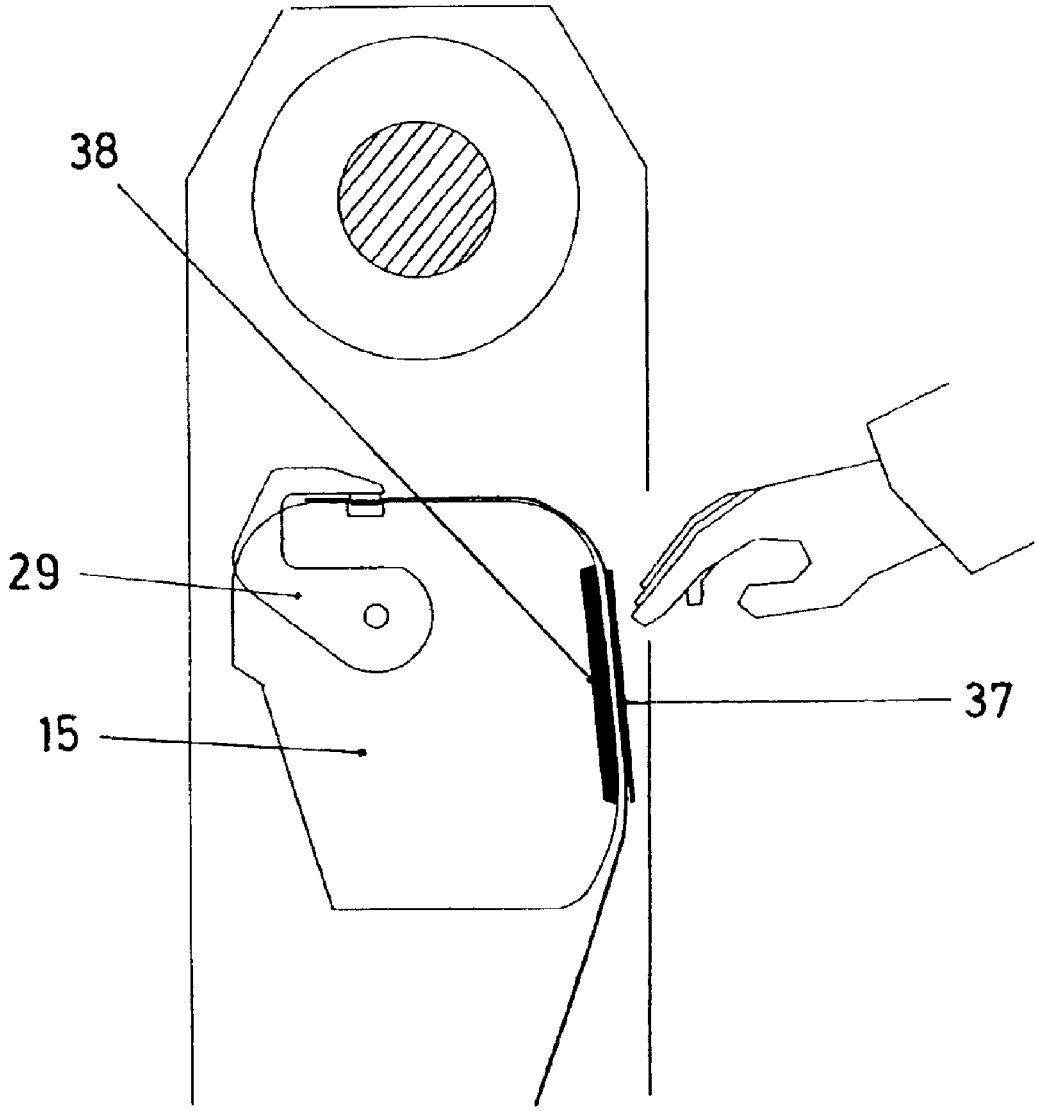

Then, as shown in FIG. 14, the operator places a double-faced adhesive tape (37) on the laminar web, making sure it coincides opposite an elastic seat (38) fitted on the bar (15), and by means of a button provided confirms that the splicing is ready.

Figure 15:
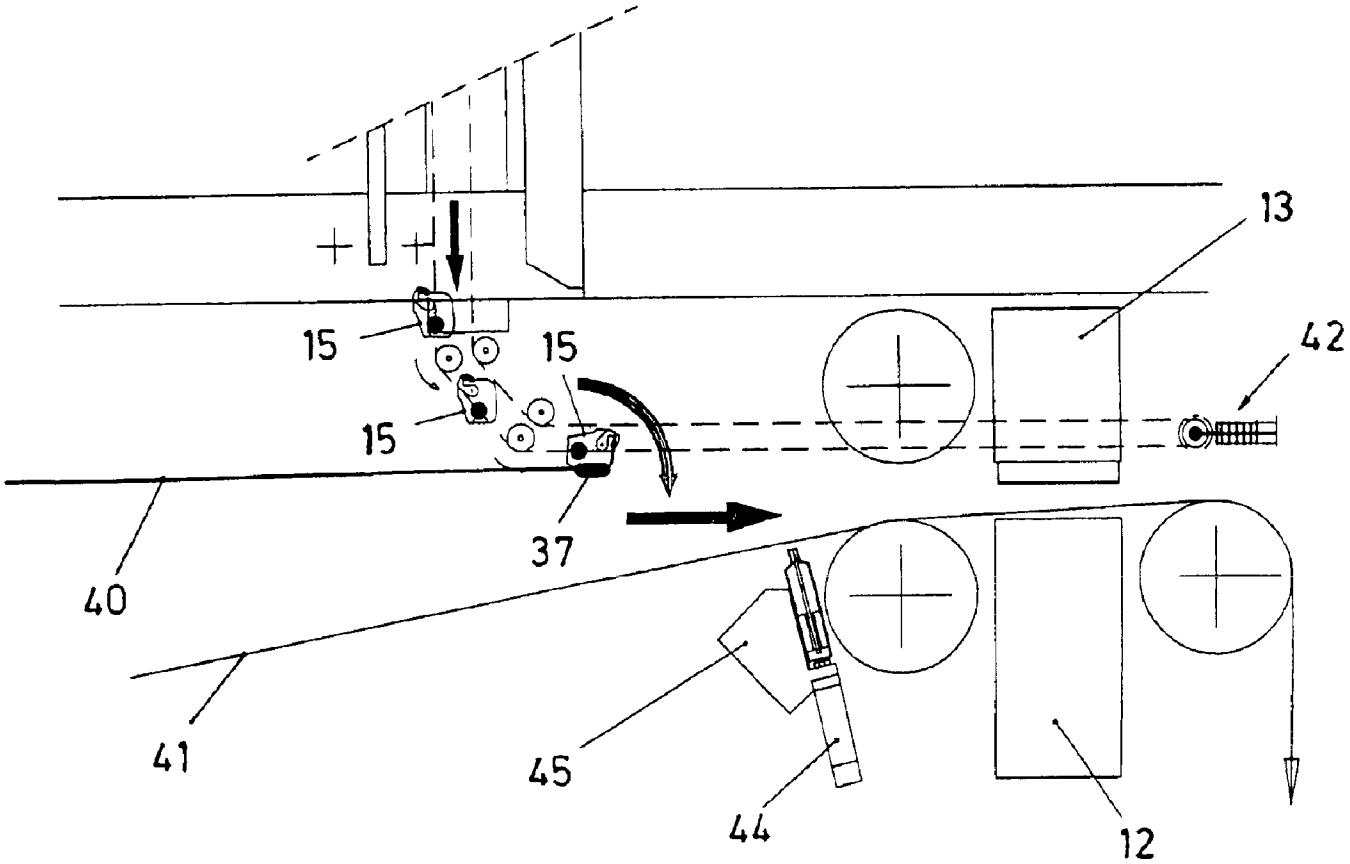
FIGS. 15, 16 and 17 illustrate three successive positions of the operation of automatic splicing of a laminar web in stand-by status onto the infeed web, according to the system of the invention.

By means of a button, operated by the operator, or else automatically, when the reel in operation (32) reaches a diameter below a preset figure, the bar (15) moves toward the splicing head (11), by means of a rack and pinion system, in a manner whereby said displacement consists mainly of a vertical downward run and a horizontal run that ends at the moving bar (13), as shown in FIG. 15.

At the beginning of the horizontal displacement, by means of a mechanical device, the bar (15) turns 90°, in a manner whereby the adhesive tape (37) remains facing downwards. Subsequently, the bar (15) continues its horizontal displacement until it stops beneath the moving bar (13), a position that is detected by means of a sensor and, in an automatic manner, the stand-by reel (26) is rotated in a manner that the leading edge (28) of the web of the same is tensed between said reel (25) and the bar (15).

In this position, either manually by means of a button operated by the operator or by an automatic system that cuts in when the reel in operation (32) reaches a diameter below the preset figure, or else by means of an ultrasound sensor that constantly measures the diameter of the reel (32), the splicing sequence begins.

Prior to this sequence, the moving roller (18) is displaced from the intermediate height position that it normally occupies to a higher position and then, once the sequence has begun, the speed at which the web is supplied to the application process falls to a preset splicing speed.

Figure 16:
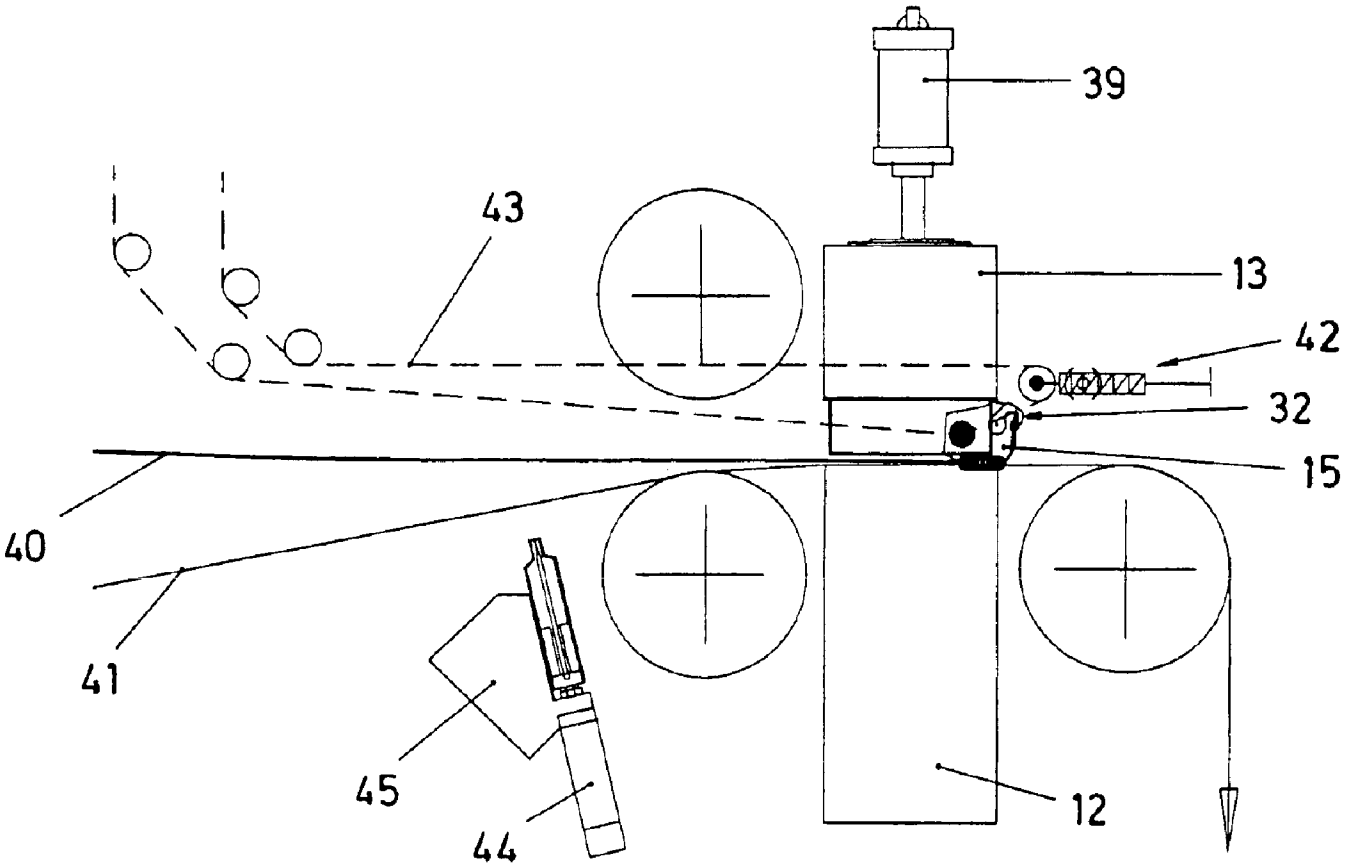
Figure 17:
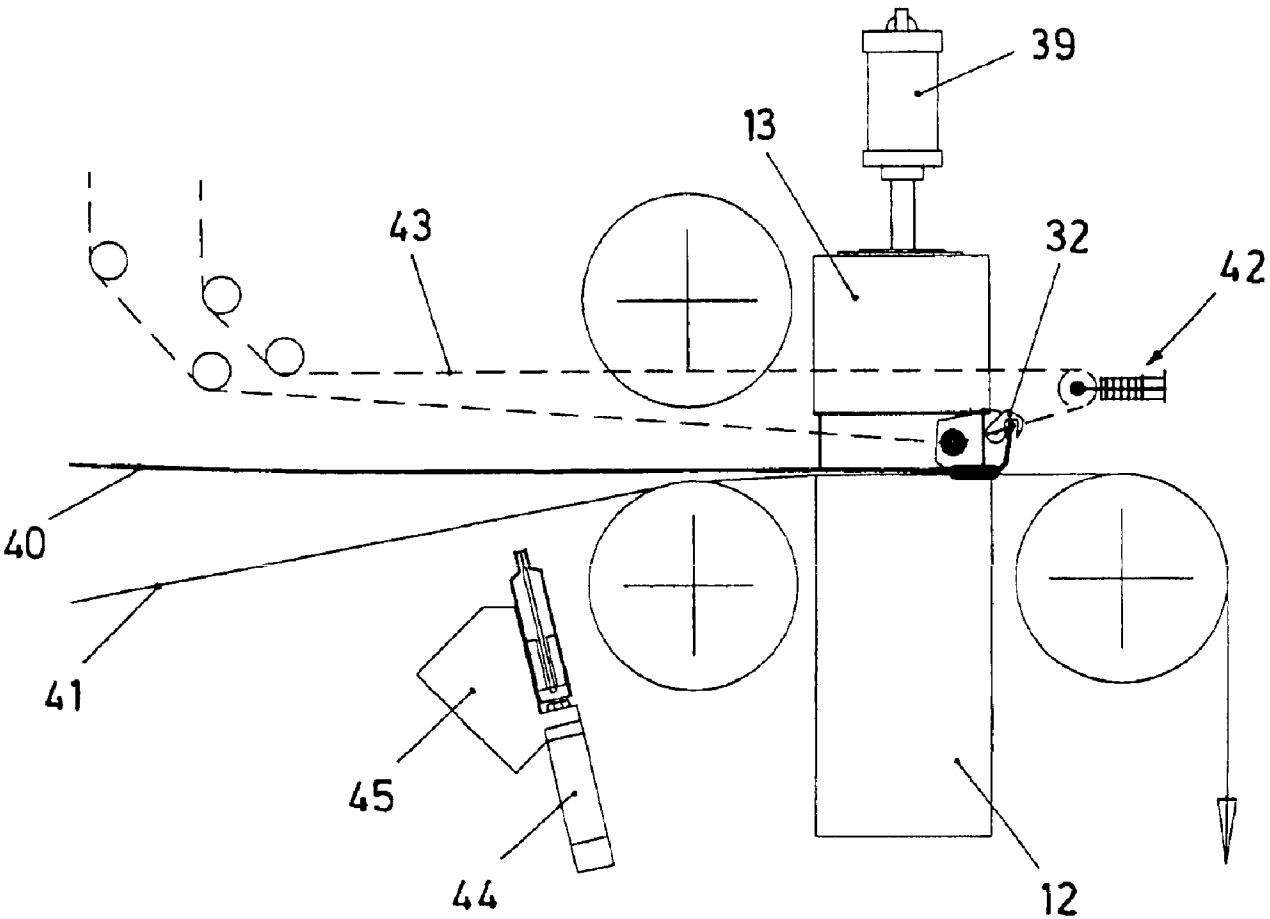

At the same moment as the infeed web reaches the preset splicing speed, the reel in operation (32) stops, which is ratified by means of the feedback encoder on the motor (9) of the corresponding cone-carrier (4), with said confirmation activating several pneumatic cylinders (39) which cause the bar (13) to impact against the bar (15) and this in turn against the fixed bar (12), joining the leading edge (28) of the stand-by web (40) to the web in operation (41), by means of the adhesive tape (37), as shown in FIG. 16.

A tensor (42) ensures that tension is maintained on a chain (43) that draws on the bar (15), allowing for the necessary margin of displacement on the aforementioned bar (15) during the impact.

Figure 18:
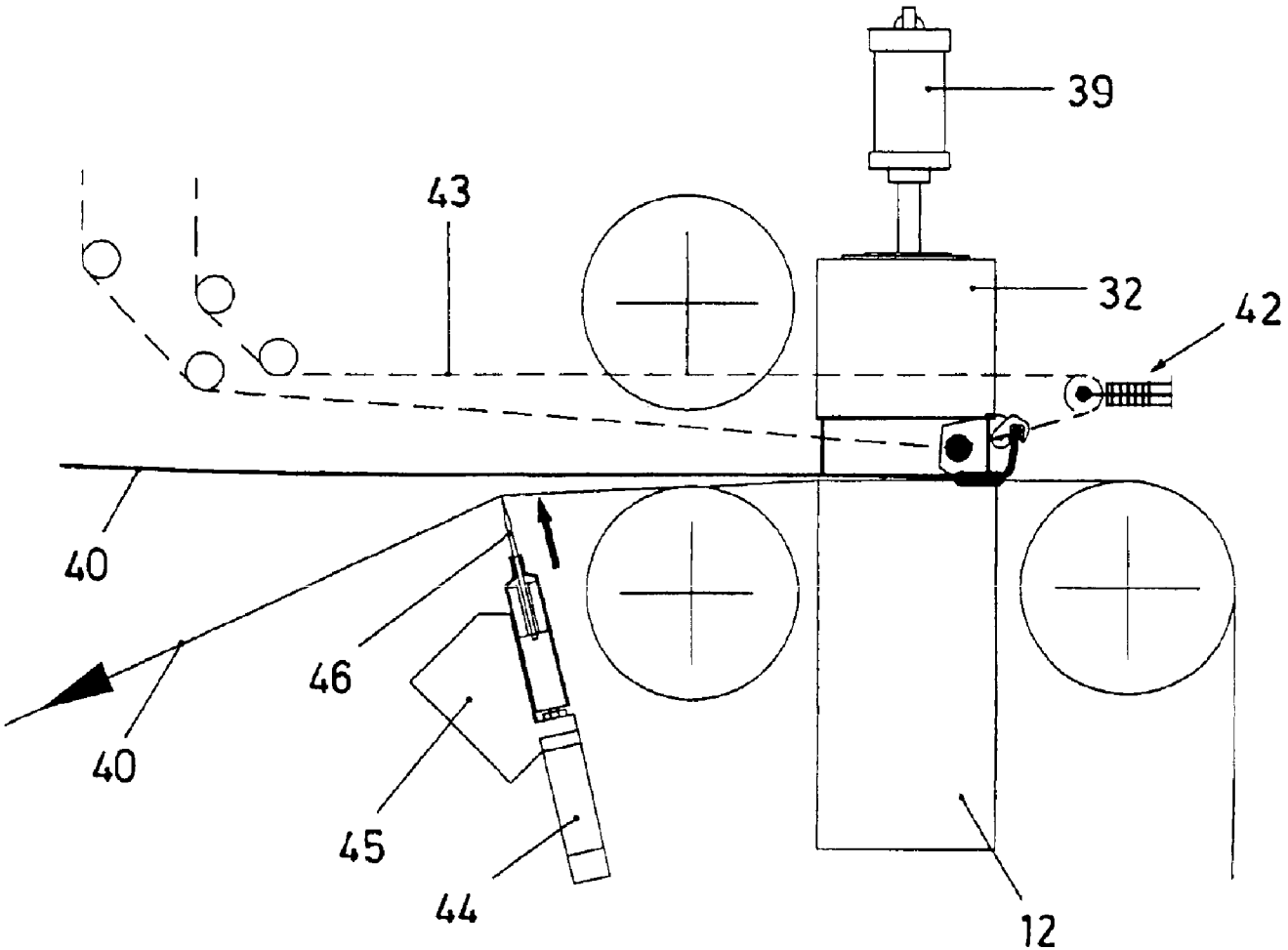
FIGS. 18 and 19 show two successive positions of the automatic cutting operation of the web from the spent reel, subsequent to the splicing of the new web for continuing the supply.
Figure 19:
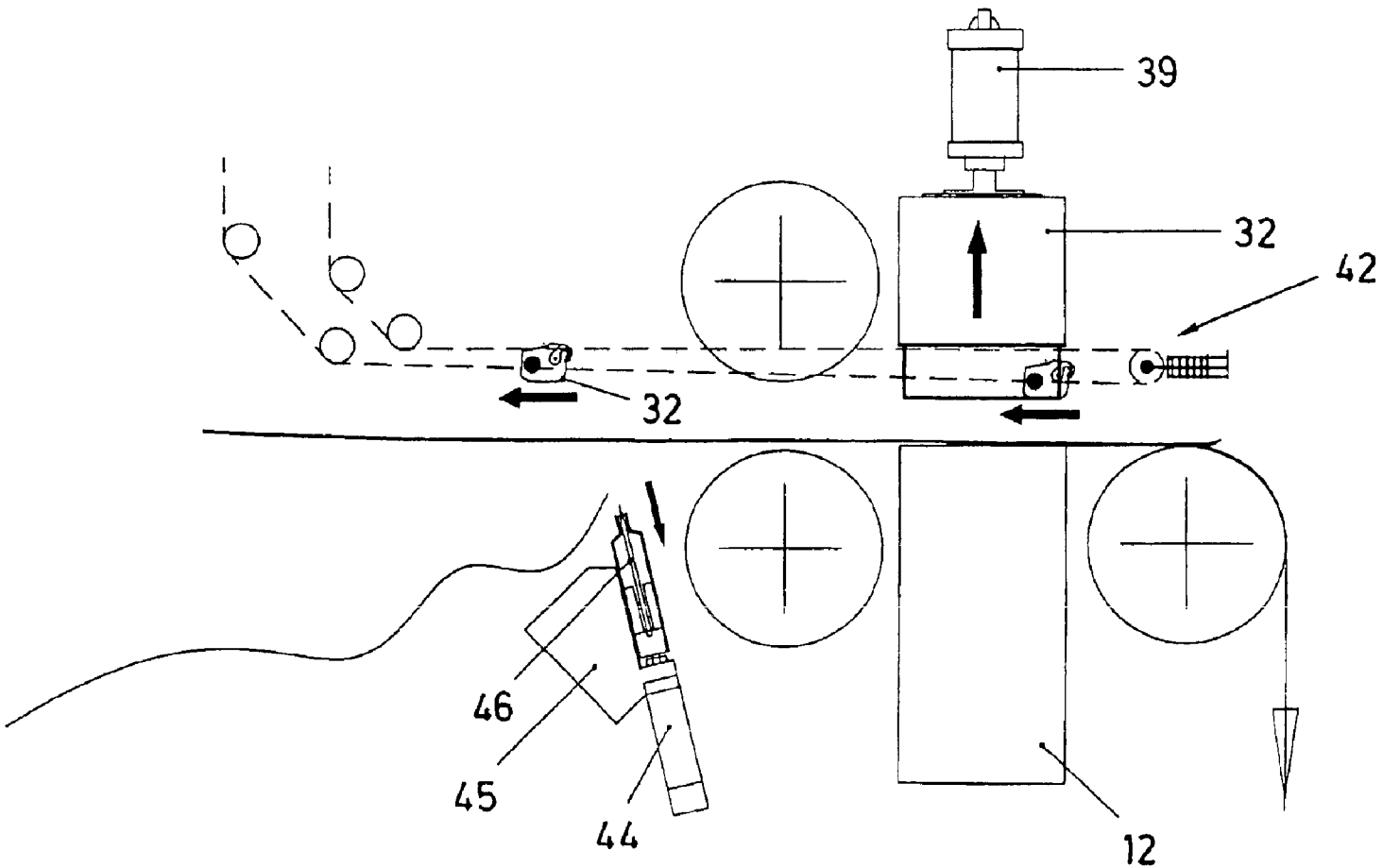

The next stage is the activation of various pneumatic cylinders (44) in a cutting device (45) which comprises a blade (46), which is displaced until it rests against the web in operation (41), as illustrated in FIG. 18; thereupon reversal is made of the direction of rotation of the motor (9) of the cone-carrier (4) assembly of the reel (32) supplying said web (41), which puts a strain on said web (41), which leads to the cutting of the same on the blade (46). In order to facilitate the cutting procedure, the blade (46) is designed in the shape of a comb, so that the cutting tips stick into the web (41), with the cut progressing easily between the points of incision.

At the same time as the cut is effected, various pneumatic cylinders act upon the clamp (29), separating it from the bar (15), whereby the leading edge (28) of the stand-by web (40) is freed.

Subsequently, the pneumatic cylinders (39) are activated, making the moving bar (13) withdraw, whereby the bar (15) is freed and the web (40) can run joined to the web (41), thanks to the adherence between them arising from the adhesive tape (37). At the same time the pneumatic cylinders that acted upon the clamp (32) withdraw, with said clamp (32) closing once again on the bar (15), whilst the tensor (42) ensures that the chain (43) returns to its normal position of operation. On the other hand, the cutting blade (46) returns to its inactive position within the cutting device (45), by means of the operation of the cylinders (44).

The next stage is the acceleration of the fresh reel (25), by means of the motor (9) on the corresponding cone-carrier assembly (4), until it teaches the line speed. Both the acceleration and the torque developed by the motor (9) are calculated by an automation device, taking into account the diameter of the fresh reel (25), which is measured at all times by means of an ultrasound sensor.

At the same time, the bar (15) returns automatically to the initial position and both the line and the fresh reel (25) subsequently accelerate, until they reach normal operating speed.

Figure 20:
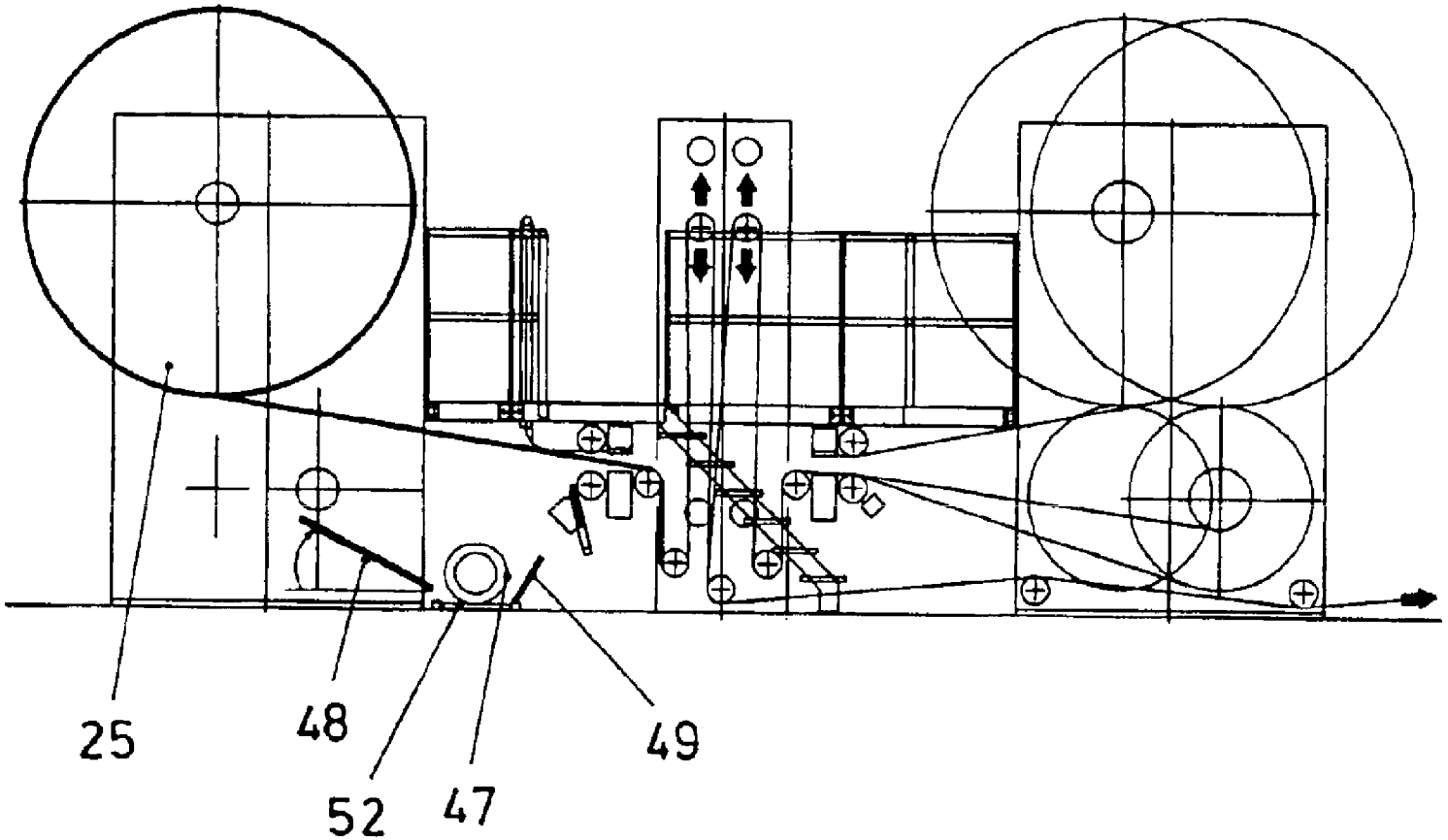
FIG. 20 is a side view of the installation of the system in the operation for the removal of the mandrel of a spent reel.

Once the splicing procedure has been performed, and either by manual operation of a button or in an automatic manner, the sequence begins for the removal of the mandrel (47) from the spent reel (32), for which the motor (9) of the corresponding cone-carrier (4) rotates in the appropriate direction for taking up the part of the web (41) that has been left over on the spent reel (32) and at the same time a ramp (48) located on the lower part is raised, as well as a mechanical stop (49) situated in front of said ramp (48), as is shown in FIG. 20.

Once the ramp (48) and the stop (49) have been raised, the withdrawal of the keys (23) is activated from the corresponding cones (7 and 8), which is verified by a sensor, and then the cone-carriers (3 and 4) move, drawing apart from one another, with activation at the same time of pneumatic ejectors fitted in the cones (7 and 8), whereby it is ensured that said cones (7 and 8) are ejected from the bushings (21) inserted in the mandrel (47), in a manner that renders said mandrel (47) free of any attachment and it falls onto the ramp (48).

When it falls onto the ramp (48) the mandrel (47) rolls down it and reaches the stop (49), where it comes to rest on a conveyor belt (52) that removes it, with the ramp (48) and the stop (49) then returning to the lower position.

When the cones (7 and 8) separate to release the mandrel (47) to be removed, the assembly of said cones (7 and 8) is raised until it reaches the upper position in the vertical structures (6). And in this position, when the diameter of the fresh reel in operation (25) reaches a preset figure, said reel (25) is displaced downwards, to a position defined by a photocell, leaving the upper area free for loading a new reel between the cones (7 and 8), enabling the loading sequence for the new reel to be performed in the same manner as described before.

During the normal unwinding, taking as reference the speed of the line of the web that is being supplied, the system calculates the rotation speed of the reel in operation (32) taking into account its diameter, by means of the comparison of the pulses of an encoder fitted on the input roller (16) on the unit (50) in FIG. 1, with a detector that counts the revolutions made by the reel in operation (32).

This permits the calculation of the theoretical speed of rotation of the reel (32) in order to ensure an output speed for the web equal to that of the line. In order to compensate for error of calculation, placed at the output of the splicing head (11) is the unit (50), a vertical rocker arm, in which the operating tension is preset by means of various counterweights. The position of the moving roller (18) of the unit (50) is known by means of an encoder (51) located in the drive system (20) of said roller (18). The position of the aforementioned roller (18) acts as an addition or subtraction function to the theoretical speed calculated beforehand, ensuring the stability of the system by maintaining the aforementioned moving roller (18) in a fixed position, preset in the control system.

In the same manner, in the sequence for the acceleration and deceleration of the line, the increases and reductions in the torque of the brake are accurately calculated in order to compensate the mechanical inertia of the system and so ensure the stability of the system.

As has been described above, during the splicing sequence the reel in operation (32) is fully stopped whilst the line continues to be fed at a preset speed, which is undertaken by means of the web stored on the rocker unit (50), which accordingly is positioned in its position of maximum capacity, in other words with the moving roller (18) in the upper position, to gradually drop, whilst the supply of material from the reels is halted, thus providing the supply to the line, during that period, by means of the web stored.

Once the splicing sequence has been completed, the acceleration gradient is calculated for the fresh reel (25), for which account is taken of the web that still remains available on the rocker unit (50), which is known by means of the encoder (51), to ensure that the acceleration gradient is as gentle as possible by means of the use of the remaining web existing on the rocker unit (50). Once the acceleration of the fresh reel (25) has been completed, the motor (9) of the corresponding cone-carrier (4) increases the speed of rotation, whereby the speed of the line is increased beyond the normal speed of operation, thus enabling the roller (18) to return to the operating position at mid-height in the unit (50), maintaining the speed of the infeed line to the application process.

What is claimed is:

1. An unwinding system for handling reels of tissue comprising:

for each ply of laminar tissue to be applied a pair of reels, of which one supplies a laminar web to be applied, whilst the other is placed on stand-by to be spliced onto an infeed line when the supply reel is spent, wherein:

the pair of reels are mounted in respective reel-carrier assemblies which are capable of vertical displacement, with one reel being located on an upper part and the other on a lower part at a distance between them that enables the reel in stand-by to be prepared whilst the other reel is in an operating mode;

each reel is mounted between respective holding cones that control unwinding rotation, with said cones also being capable of being moved closer together or further apart for loading and unloading of the corresponding reel;

a reel-carrier from which one of the reels is removed is displaced vertically until it occupies the upper part, whilst a reel-carrier that holds a fresh reel that is coming into operation drops to a lower position, freeing the upper part for incorporation of a new reel in the reel-carrier that has become unoccupied; and a splicing mechanism for automatic splicing of the laminar web on the reel in stand-by with the web on the reel in operation when the latter is spent, with said mechanism comprising a fixed bar, a moving bar operated by pneumatic cylinders that is capable of being displaced towards the fixed bar and another moving bar operated by a chain and pinion system that is capable of displacement between a position of operation and a position of insertion between the fixed bar and the moving bar to be grasped between them, with said other moving bar incorporating a clamp such that a leading edge of the laminar web that is in the stand-by position may be taken up.

2. An unwinding system for handling reels of tissue as recited in claim 1, wherein for application of two laminar plies of tissue two symmetrical unwinding units are arranged, each unwinding unit comprising respective reel-carrier assemblies capable of being displaced vertically and fitted with cones for holding the corresponding reels.

3. An unwinding system for handling reels of tissue as recited in claim 1, wherein the splicing mechanism comprises an automatic cutting system which is fitted with a blade capable of displacement by pneumatic action to a position resting on web of the reel in operation, in conjunction with a change in direction of rotation of said reel in operation that causes a tug on the web, which thus effectively leads to a cutting of said web subsequent to a splicing of fresh web which is to continue the supply; with the blade (46) being envisaged in the shape of a comb, to facilitate the incision on the web to be cut.

4. An unwinding system for handling reels of tissue as recited in claim 1, wherein inserted into each reel to be mounted on the unwinding device there are bushings that are fitted into ends of a mandrel of each corresponding reel, with said bushings featuring lateral windows, to act as sockets for expansion keys on the cones for holding the reel in the assembly, which are inserted into said bushings, establishing a rotary connection for operation of the corresponding reel by means of said insertion of the keys into the windows on the aforementioned bushings.

5. An unwinding system for handling reels of tissue as recited in claim 4, wherein the bushings comprise a groove that remains on an outside of the reel to be incorporated, for its attachment with said groove onto devices for lifting the reel into position on the assembly, the groove having positioning contours to adapt to the lifting device so that the bushings are positioned to ensure that the keys on the holding cones fit into the windows.

6. An unwinding system for handling reels of tissue as recited in claim 1, wherein below each reel-carrier assembly a retractable ramp is provided, with a stop also retractable and in front of it, which comprises a receiving area for unloading by freefall of mandrels of the spent reels, to situate said mandrels on a conveyor belt for their removal.

7. An unwinding system for handling reels of tissue comprising:

for each ply of laminar tissue to be applied a pair of reels, of which one supplies a laminar web to be applied, whilst the other is placed on stand-by to be spliced onto an infeed line when the supply reel is spent, wherein:

the pair of reels are mounted in respective reel-carrier assemblies which are capable of vertical displacement, with one reel being located on an upper part and the other on a lower part at a distance between them that enables the reel in stand-by to be prepared whilst the other reel is in an operating mode;

each reel is mounted between respective holding cones that control unwinding rotation, with said cones also being capable of being moved closer together or further apart for loading and unloading of the corresponding reel;

a reel-carrier from which one of the reels is removed is displaced vertically until it occupies the upper part, whilst a reel-carrier that holds a fresh reel that is coming into operation drops to a lower position, freeing the upper cart for incorporation of a new reel in the reel-carrier that has become unoccupied; and an outlet having a mechanism comprising two fixed rollers and a moving roller capable of vertical displacement and controlled by a synchronization device, with said mechanism comprising a rocker arm unit for tension in a supply line and a magazine for passage of corresponding web for continuity of the supply during splicing.

* * * * *